US009225106B2

(12) United States Patent
Oduca

(10) Patent No.: US 9,225,106 B2
(45) **Date of Patent: *Dec. 29, 2015**

(54) ENVIRONMENTALLY SEALED CONTACT

(71) Applicant: Carlisle Interconnect Technologies, Inc., Saint Augustine, FL (US)

(72) Inventor: Laudencio Oduca, West Covina, CA (US)

(73) Assignee: Carlisle Interconnect Technologies, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 14/584,701

(22) Filed: Dec. 29, 2014

(65) Prior Publication Data

US 2015/0118893 A1 Apr. 30, 2015

Related U.S. Application Data

(63) Continuation of application No. 13/800,745, filed on Mar. 13, 2013, now Pat. No. 8,926,361.

(51) Int. Cl.

| | |
|---|---|
| ***H01R 13/52*** | (2006.01) |
| ***H01R 43/048*** | (2006.01) |
| ***H01R 4/18*** | (2006.01) |
| ***H01R 4/70*** | (2006.01) |
| ***H01R 43/00*** | (2006.01) |
| ***H01R 13/24*** | (2006.01) |

(52) U.S. Cl.

CPC ..... *H01R 13/5219* (2013.01); *H01R 4/183* (2013.01); *H01R 4/70* (2013.01); *H01R 13/24* (2013.01); *H01R 43/005* (2013.01); *H01R 43/048* (2013.01); *Y10T 29/49185* (2015.01)

(58) Field of Classification Search

CPC .. H01R 11/281; H01R 13/5216; H01R 13/52; H01R 13/405; H01R 2201/16

USPC ..... 439/519, 587, 877, 948, 879, 884

See application file for complete search history.

(56) References Cited

U.S. PATENT DOCUMENTS

| | | | |
|---|---|---|---|
| 2,430,159 | A | 11/1947 | Chenier |
| 4,120,556 | A | 10/1978 | Waldron et al. |
| 4,330,168 | A | 5/1982 | Arnold |
| 4,521,961 | A | 6/1985 | Roeschlein |
| 4,529,257 | A | 7/1985 | Goodman et al. |
| 4,753,609 | A | 6/1988 | Pfeffer et al. |
| 4,778,404 | A | 10/1988 | Pass |
| 5,018,985 | A | 5/1991 | Moore |
| 5,046,968 | A | 9/1991 | Baur et al. |
| 5,175,927 | A | 1/1993 | Coniff |
| 5,533,913 | A | 7/1996 | Boehm et al. |

(Continued)

*Primary Examiner* — Phuong Dinh

(74) *Attorney, Agent, or Firm* — Wood, Herron & Evans, LLP

(57) ABSTRACT

An electrical contact includes a contact body having a mating portion and a barrel portion configured for receiving an electrical conductor. The barrel portion includes a wall defining a bore having a closed end and open end, and the bore includes a core receiver portion for receiving the core of an electrical conductor and a plug receiver portion adjacent the closed end of the bore. A hole is formed in the barrel portion proximate the closed end of the bore and extending into the plug receiver portion of the bore through the wall. A plug has a body portion configured to be inserted into the bore and to engage the plug receiver portion of the bore. The plug is disposed in the end of the plug receiver portion and is further configured to seal the plug receiving portion of the bore and the hole from the rest of the bore.

20 Claims, 4 Drawing Sheets

(56) References Cited

U.S. PATENT DOCUMENTS

| | | | | |
|---|---|---|---|---|
| 5,888,091 | A | 3/1999 | McQuilkin Murr | |
| 6,004,172 | A | 12/1999 | Kerek | |
| 6,200,156 | B1 | 3/2001 | Hiraki et al. | |
| 7,312,400 | B2 | 12/2007 | Ito et al. | |
| 7,695,331 | B2 | 4/2010 | Kerner | |
| 7,905,755 | B1 | 3/2011 | Martauz | |
| 8,052,488 | B2 | 11/2011 | Ohki | |
| 8,251,758 | B2 | 8/2012 | Yoshida | |
| 8,926,361 | B2 * | 1/2015 | Oduca | 439/519 |

* cited by examiner

| Size | Pressure | Leakage Measured | Leakage Observed | Pressure | Leakage Measured | Leakage Observed | Contact Resistance | | Tensile Strength | |
|---|---|---|---|---|---|---|---|---|---|---|
| | | | | | | | Reqmt | Reqmt | Measured | Measured |
| 22 | 14.5 PSI | 0 $cm^3$/hr | None | 20 PSI | 0 $cm^3$/hr | None | 9MΩ | <9MΩ | 41n Min | 67-72n |
| 12 | 14.5 PSI | 0 $cm^3$/hr | None | 20 PSI | 0 $cm^3$/hr | None | 5MΩ | <5MΩ | 246n Min | 350-385n |
| At 1 bar (14.5 PSI) applied the connection shall not exceed 12 $cm^3$/hr leakage | | | | | | | | | | |
| Initial Test Results | | | | | | | | | | |

FIG. 6

| Size | Pressure | Leakage Measured | Leakage Observed | Pressure | Leakage Measured | Leakage Observed | Contact Resistance | | Tensile Strength | |
|---|---|---|---|---|---|---|---|---|---|---|
| | | | | | | | Reqmt | Reqmt | Measured | Measured |
| 22 | 14.5 PSI | 0 $cm^3$/hr | None | 20 PSI | 0 $cm^3$/hr | None | 9MΩ | <9MΩ | 41n Min | 62-67n |
| At 1 bar (14.5 PSI) applied the connection shall not exceed 16 $cm^3$/hr leakage | | | | | | | | | | |
| After 500 Thermal Shock Cycles | | | | | | | | | | |

FIG. 7

ENVIRONMENTALLY SEALED CONTACT

RELATED APPLICATIONS

This application is a Continuation application of U.S. patent application Ser. No. 13/800,745, entitled "ENVIRONMENTALLY SEALED CONTACT", filed Mar. 13, 2013, which application is herein incorporated by reference in its entirety.

FIELD OF THE INVENTION

This invention relates to electrical contacts. Specifically, the invention relates to apparatus and methods for environmentally sealed electrical contacts for use in contaminating environments.

BACKGROUND OF THE INVENTION

Electrical contacts are conventionally provided as a means to provide separable continuity between the electrically conductive core of an insulated electrical wire and an electrical terminal, conductive core of another insulated electrical wire, or other device. They are used, for example, in lieu of solder joints for providing an electrical connection. The electrically conductive cores are typically composed of a conductive metallic material such as, copper, silver, gold, aluminum, their alloys, or the like. The cores may or may not be plated with a conductive-metal plating material.

Electrical contact assemblies often take a form in which a male or female mating portion and a barrel portion are generally aligned along a common axis. The contact is generally designed as either a male pin configured to be axially inserted into a female socket, or a female socket into which a male pin is to be inserted. In either configuration, the purpose of mating the male pin and the female socket is to complete an electrical circuit. The barrel portion or barrel has an axially extending tubular bore that is configured to receive and provide an attachment location for the core of an insulated electrical wire. When the barrel is of the type described as a closed barrel, the electrical contact is typically gold plated. For a plated contact, a small hole is radially disposed through the tubular wall of the barrel near the bottom end of the closed axially extending bore. This hole is required to allow full surface contact with plating solutions during the plating or manufacturing process.

During the assembly of the electrical contact to the end of an electrical wire, the insulation is stripped from the tip of the wire to expose a short length of the electrically conductive core of the wire. The short length of exposed core is then inserted into the axially extending bore in the tubular barrel of the electrical contact. The core of the wire may be either stranded or solid. The tubular wall of the barrel is then typically crimped into contact and electrical continuity with the bare tip of the core of the wire that is within the axial cavity. In some connector assemblies, the tubular barrel is also deformed, typically by crimping, into a hermetically sealing contact with the insulated coating on the wire.

As mentioned above, a hole, sometimes referred to as a bleeder hole, is disposed through the tubular wall of the barrel to facilitate plating. Consequently, the tubular bore of the closed barrel and the exposed core of the wire are partially exposed to the environment as a result of the hole. This hole produces an undesirable pathway for environmental contaminants, such as water or corrosive chemicals, to propagate to the conductive core of the wire. Entry of such contaminants can corrode the wire core, increase the electrical resistance value of the core/barrel interface, embrittle the core, or otherwise degrade the quality or longevity of the electrical and physical properties of the contact assembly.

Previous attempts to environmentally seal the bleeder hole have proven to be costly or have resulted in degradation of the core/bore interface. One ineffective solution involved placing a silver or malleable sleeve between the electrically conductive core of the wire and the bore of the barrel. Such a solution is costly due to the silver and only provided a moderate performance in environmentally sealing the contact assembly. Also, with such an arrangement, electrical conductivity between the core and the bore of the barrel was diminished and the contact resistance increased. Additionally, tensile strength of the mated wire and contact was diminished by the addition of the silver sleeve.

Another ineffective solution required placing a sleeve over the barrel of the contact assembly. While this avoided degrading the electrical connection of the core to the bore of the barrel, the loose outer sleeves could be lost or separated from the connector assembly prior to crimping them in place. Additionally, the loose outer sleeves often required complex geometries to ensure an adequate seal when applied with relatively complex crimping profiles.

Therefore, there is a need for an effective environmentally sealed contact that yields excellent electrical conductivity as well as a robust physical design while being generally free of loose parts or sealing sleeves.

SUMMARY OF THE INVENTION

In one embodiment of the invention, a contact body having a mating portion and a barrel portion configured for receiving an end of an electrical conductor is provided. The barrel portion includes a wall defining a bore having a closed end and open end. The bore includes a core receiver portion for receiving the core of an electrical conductor and a plug receiver portion is adjacent the closed end of the bore. A hole is formed in the barrel portion proximate the closed end of the bore and extends into the plug receiver portion of the bore through the wall. A plug has a body portion configured to be inserted into the bore and to engage the plug receiver portion of the bore. The plug is further configured for being inserted into an end of the plug receiving portion to seal the plug receiving portion of the bore and the hole from the rest of the bore. The plug being disposed in the end of the plug receiver portion. An insulation receiver portion is disposed near the open end of the bore. A primary crimp region is disposed radially coincident to the core receiver portion and is configured to receive one or more crimp distortions. A secondary crimp region radially coincident with the insulation receiver portion is configured to receive one or more crimp distortions.

In another embodiment of the invention, an electrical contact assembly is provided. The electrical contact assembly includes a contact body having a mating portion and a barrel portion configured for receiving an end of an electrical conductor. The barrel portion including a wall defining a bore having a closed end and open end. The bore includes a core receiver portion for receiving the core of an electrical conductor and a plug receiver portion adjacent the closed end of the bore. A hole is formed in the barrel portion proximate the closed end of the bore and extends into the plug receiver portion of the bore through the wall. A plug has a body portion configured to be inserted into the bore and to engage the plug receiver portion of the bore. The plug is further configured for being inserted into an end of the plug receiving portion to seal the plug receiving portion of the bore and the hole from the rest of the bore. The plug is disposed in the end of the plug receiver portion. An insulation receiver portion is disposed near the open end of the bore. A wire having a conductive core covered in insulation is included. The core is disposed within the core receiver portion, and the insulation is disposed within the insulation receiver portion. A primary crimp region is disposed radially coincident to the core receiver portion and is impressed with one or more crimp distortions. A secondary crimp region radially coincident with the insulation receiver portion is impressed with one or more crimp distortions.

In another embodiment of the invention, a method producing an environmentally sealed electrical contact assembly is provided. The method uses a contact including a contact body having a mating portion and a barrel portion configured for receiving an end of an electrical conductor. The barrel portion includes a wall defining a bore having a closed end and open end. The bore includes a core receiver portion for receiving the core of an electrical conductor and a plug receiver portion adjacent the closed end of the bore. A hole is formed in the barrel portion proximate the closed end of the bore and extends into the plug receiver portion of the bore through the wall. An insulation receiver portion is disposed near the open end of the bore. A primary crimp region is disposed radially coincident to the core receiver portion and is configured to receive one or more crimp distortions. A secondary crimp region is radially coincident with the insulation receiver portion and is configured to receive one or more crimp distortions. The method includes inserting a plug having a body portion into the open end of the bore. The method also includes pressing the plug into an end of the plug receiving portion to seal the plug receiving portion of the bore and the hole from the rest of the bore. The method further includes inserting the core of a wire into the core receiver portion and inserting an insulation of the wire into the insulation receiver portion. The method lastly includes impressing one or more crimp distortions into a primary crimp region disposed radially coincident to the core receiver portion, and impressing one or more crimp distortions into a secondary crimp region radially coincident with the insulation receiver portion to establish an environmental seal between the bore and the insulation.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

FIG. 6 is a table of test data corresponding to an embodiment of the invention.

FIG. 7 is a table of test data corresponding to an embodiment of the invention.

DETAILED DESCRIPTION

Figure 1:
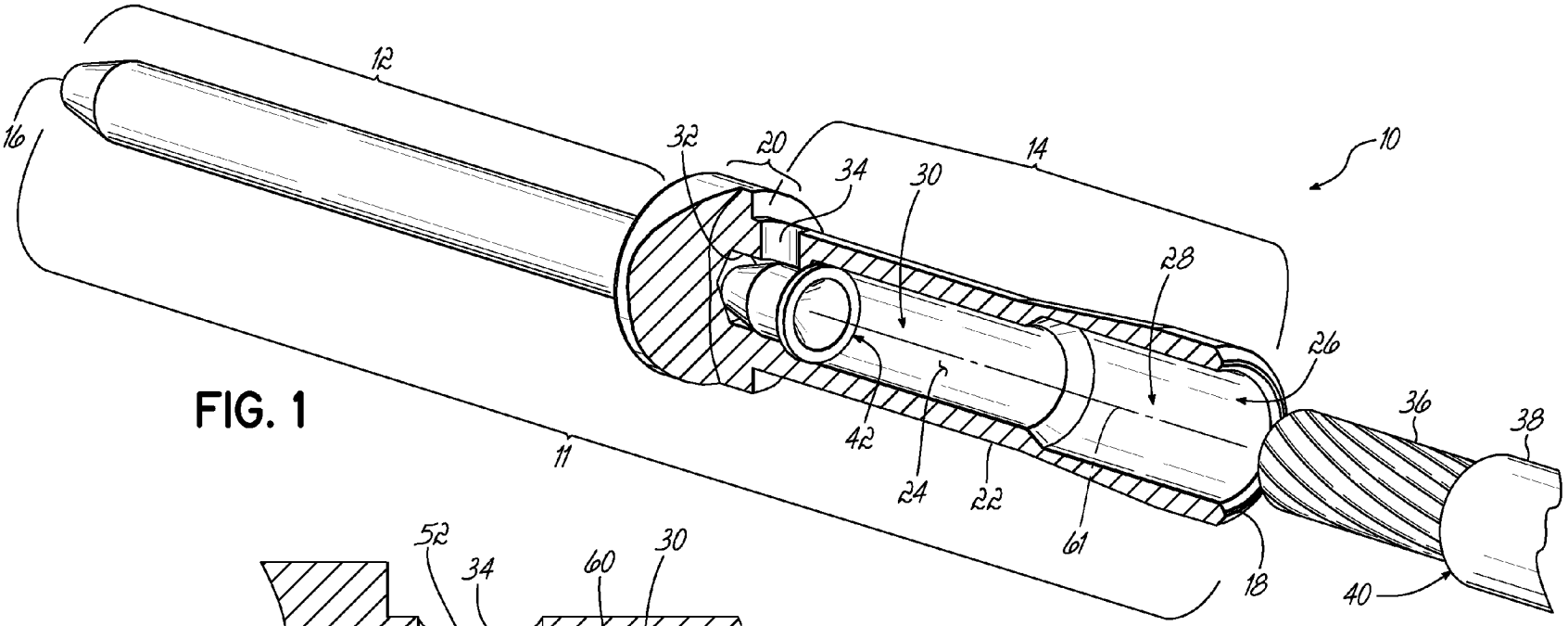
FIG. 1 is a partially dissembled cross-sectional view in partial longitudinal cross section of an embodiment of the invention.
Figure 5:
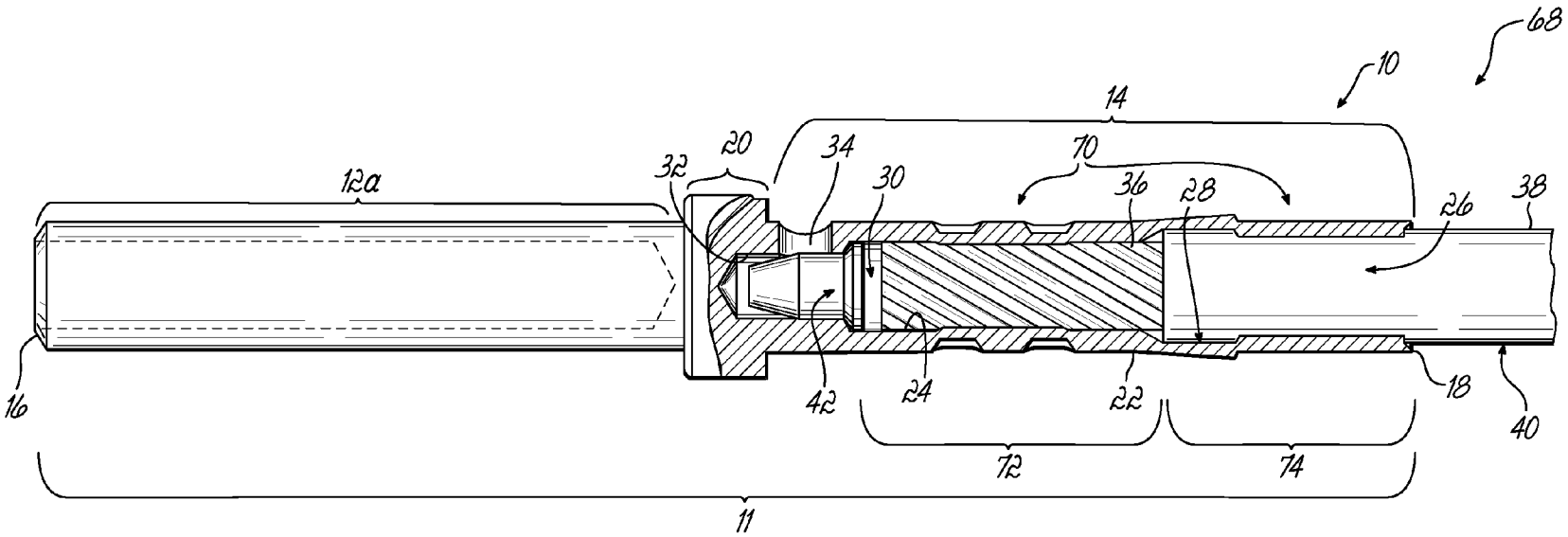
FIG. 5 is a partial side cut-away view of an assembly of an embodiment of the invention having a female socket.

A partially dissembled cross sectional perspective view one embodiment of an environmentally sealed contact 10 is shown in FIG. 1. The contact 10 has a body 11 that includes a mating portion 12 and a barrel portion 14 that are generally aligned along a common axis 61 between a distal end 16 and a proximal end 18 and are separated by a shoulder 20. The contact 10 may be fabricated from a suitable metal such as brass, copper, aluminum, silver, gold, or some other suitable electrically conductive composition. In one embodiment, the contact 10 is gold plated over a nickel underplate. The mating portion 12 may be a pin, socket, plug, receptacle, spade, eyelet, or the like. In the embodiment illustrated in FIG. 1, the mating portion 12 is in the form of a male pin. Alternatively, in FIG. 5, a female socket 12*a* is shown. The barrel portion 14 is tubular and has an outer wall 22 and an inner wall 24. The inner wall 24 forms a bore 26 having a plurality of portions. Starting at the distal end 16 and working toward the proximal end 18, an insulation receiver portion 28, a core receiver portion 30, and a plug receiver portion 32 are linearly and coaxially disposed to form a bore 26.

A bleeder hole 34 is bored radially through the outer wall 22 and through the inner wall 24 of the barrel portion 14 and into the bore 26. The bleeder hole terminates near or within the plug receiver portion 32. When the contact 10 is submerged in various plating solutions during manufacture (e.g., cleaning fluids, nickel plating solution, gold plating solution, etc.) the hole 34 serves to facilitate full contact of those fluids with the inner wall 24 of the bore 26. In the absence of a hole 34, air trapped within the bore 26 prevents full introduction of fluids, and also frustrates draining of any solution. The bleeder hole 34, however, also provides an undesirable path for environmental contaminants to enter the contact 10 and propagate to the core 36 (and through capillary action, beneath insulation 38) of the wire 40. The core 36 of wire 40 is shown de-coupled from the connector 10 in FIG. 1.

In accordance with one embodiment of the invention to seal the contact, and specifically to seal the core receiver portion 30 and insulation receiver portion of the bore 26 from exposure to the environment through bleeder hole 34, plug 42 is used in combination with contact body 11. The plug 42 is dimensional and is configured to seal the plug receiver portion 32 and hole 34 from the receiving portion of the bore 26 and prevent the introduction of contaminants into the contact 10. In one embodiment, the plug 42 is fabricated from copper or brass alloy and plated with gold over a nickel underplate. In another embodiment, the plug 42 might be fabricated from a resilient material such as EPDM rubber or silicone.

Figure 2:
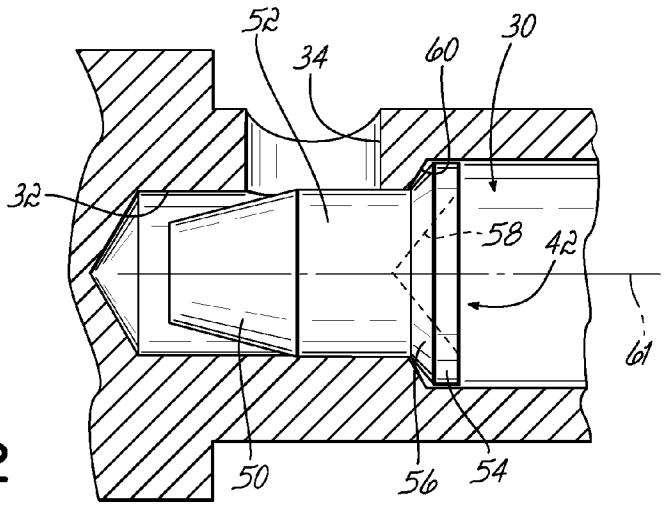
FIG. 2 is a detailed cross-sectional side view of a portion of FIG. 1

Turning attention to FIG. 2, a detail view of the interface between the plug 42 and cooperating plug receiver portion 32 of bore 26 is shown. The plug 42 includes a covered portion 50, a cylindrical body portion 52, a shoulder portion 54 having a chamfer surface 56. A depression 58 is formed in the end of the plug at the shoulder portion 54. The covered portion 50, establishes a generally frustoconical tip for the plug that is configured to guide the plug 42 down the bore 26, and into the plug receiver portion 32 during assembly. An installation press (not shown) having a reciprocating arbor or the like, is used to press fit the plug 42 into its resting position in the plug receiver portion 32 by applying an axial force to the depression 58. The shoulder portion 54 halts the travel of the plug 42 during insertion into the plug receiver portion 32. The shape of the depression 58 is selected to cooperate with the shape of any installation press equipment and may be hemispherical or angular. In one embodiment of the invention, as illustrated in the Figures, the depression 58 is configured as a conical depression centered in the plug as shown.

When the contact 10 is assembled as shown by the detail view of FIG. 2, either the cylindrical body portion 52, the shoulder portion 54, or both, may be dimensioned to provide an interference fit with the corresponding plug receiver portion 32 and core receiver portion 30 of the bore 26, respectively. It should be noted that the cylindrical body portion 52 need not be dimensional and configured to completely obscure the hole 34 in order to achieve an effective environmental seal. The bleeder hole 34 and bore portion 32 are sealed from the remaining portions of the bore 26 and the exposed core 36 of the wire. For example, if the body 52 only partially seals or obscures the hole 34, contaminants will nonetheless be halted from proximal propagation through the contact 10 as long as the body portion 52 is appropriately dimensioned to establish a press fit with the cooperating plug receiver portion 32. Additional sealing action is achieved between the interface of the chamfer surface 56 of the plug 42 and a transitional chamfer surface 60 disposed at the transition from the plug receiver portion 32 to the core receiver portion 30. In one embodiment, the chamfer surface 56 and the chamfer surface 60 are fabricated with an angle of approximately fifty degrees from a center axis 61 of the bore.

Figure 3:
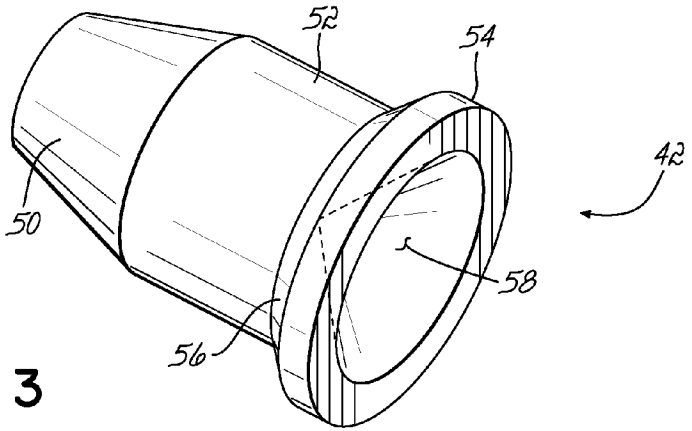
FIG. 3 is a perspective view of a component of an embodiment of the invention.

FIG. 3 shows a perspective view of the plug 42. In this view, the depression 58 and the general profile of the plug 42 are more clearly seen.

Figure 4:
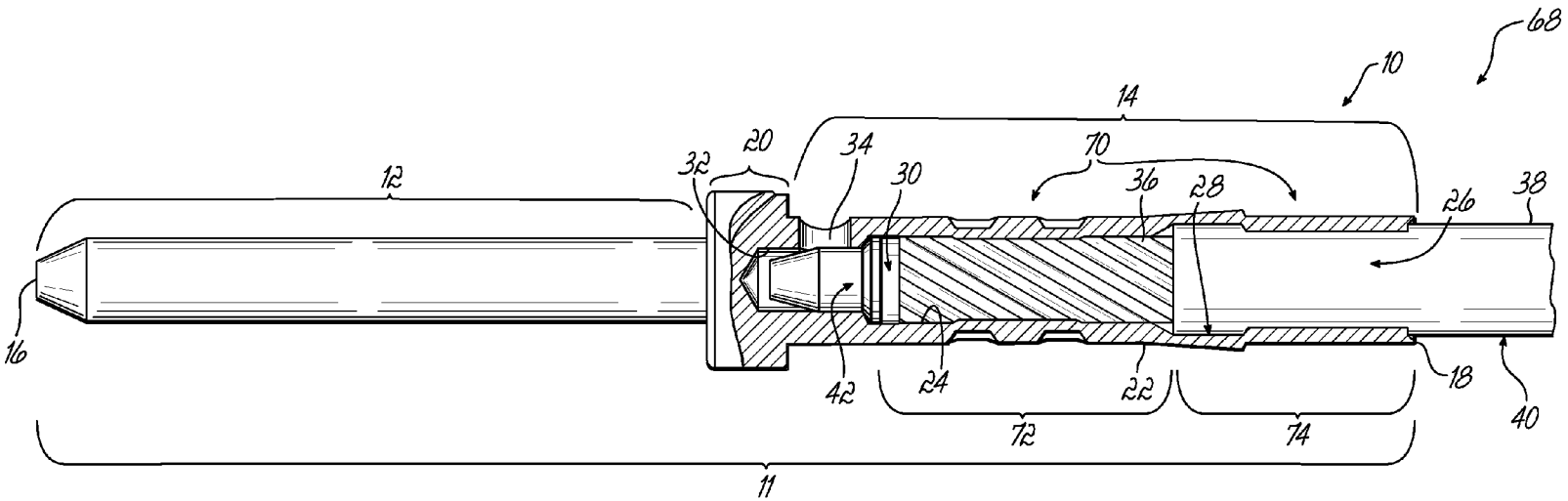
FIG. 4 is a partial side cut-away view of an assembly of an embodiment of the invention having a male pin.

FIG. 4 illustrates an environmentally sealed assembly 68 in accordance with on embodiment of the invention including the contact 10 and mated wire 40. Here the core 36 of the wire 40 is generally fully seated within the core receiver portion 30 of the bore 26. Additionally, the insulation 38 of the wire 40 is generally fully seated within the insulation receiver portion 28 of the bore 26. A plurality of crimp distortions 70 are impressed into the outer wall 22 of the barrel portion 14 in a conventional fashion. In a primary crimp region 72, the core receiver 30 of the bore 26 is crimped into physical and electrical contact with the core 36 to mechanically establish an electrical connection. The crimp distortions 70 in the primary crimp region 72 also serve to resist withdrawal of the wire 40 from the contact 10 when placed under axial tensile loads. In one embodiment, the crimp distortions 70 in the primary crimp region may be comprised of a plurality of radially applied indentations. Likewise, in a secondary crimp region 74, the insulation receiver portion 28 of the bore 26 is crimped into contact with the insulation 38 of the wire 40. In one embodiment a hexagonal crimp is used to reform the insulation receiver portion of the contact body 11. Other crimp geometries which yield a contaminant-tight interface between the insulation 38 and insulation receiver portion 28 may produce acceptable results. It should be noted that the interference fit between various surfaces of the plug 42 and bore 26 establish environmental sealing toward the distal end 16 of the bore 26, while the secondary crimp region 74 establishes environmental sealing at the proximal end 18 of the bore 26. The primary crimp region 72 is positioned behind the plug receiver portion 32 of the bore and the plug receiver portion does not receive any crimp distortions 70 so as not to disturb the seal provided by the plug.

When the contact 10 is mated and crimped to the wire 40, the integrity of the environmental seal may be verified by non destructive testing. The assembly 68, having been adequately crimped, is submerged in water. Air is injected into the core 36 of the wire 40 at a point proximal to the contact 10. An absence of bubbles exiting the contact 10 into the water provided qualitative evidence of an effective environmental seal. To provide a quantitative evaluation of environmental sealing, any air escaping the assembly 68 is captured and measured. For example, in one test regime, a 22 gauge assembly 68 is tested as explained above with an applied pressure of 14.5 PSI (1 bar) for one hour. A compliant assembly will, under this particular test regime, receive a passing score if less than 12 $cm^3$/hour of air escapes the contact 10. FIGS. 6 and 7 illustrate test results for wires terminated with the contact of the invention. It has been observed that certain embodiments of the invention yield zero $cm^3$/hour at 1 bar, and therefore greatly exceed the minimum passing criterion. The same zero leakage performance has been observed after the assembly 68 had been subjected to 500 thermal shock cycles. Additionally, contact resistance and tensile strength of the assembly 68 can be tested using conventional means known to one of ordinary skill in the art show desirable results. The elements of the disclosed invention yield contact resistance and tensile strengths that are substantially identical to comparable non-environmentally sealed contacts.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. An electrical contact comprising:

a body having a mating portion and a barrel portion;

the barrel portion including a bore formed therein and having a closed end and an open end, the open end of the bore configured for receiving an end of an electrical conductor;

a hole formed in the barrel portion and extending into the bore through a wall of the barrel portion;

a plug configured to be inserted into the bore to travel down the bore, the plug further configured to engage the bore formed in the barrel portion and to seal the hole and the closed end of the bore from the rest of the bore.

2. The electrical contact of claim 1 wherein the bore includes a core receiver portion for receiving a wire core of an electrical conductor and an insulation receiver portion configured for receiving the insulation of the electrical conductor.

3. The electrical contact of claim 1 wherein the barrel portion of the body includes a region to receive at least one crimp for securing an electrical conductor with the electrical contact.

4. The electrical contact of claim 1 wherein the bore includes a plug receiver portion positioned adjacent the closed end of the bore, the plug receiver portion configured to receive the plug for sealing the hole and closed end of the bore.

5. The electrical contact of claim 4 wherein the plug receiver portion is smaller in dimension than another portion of the bore and the plug provides a press fit into the plug receiver portion for sealing the hole and closed end of the bore.

6. The electrical contact of claim 4 wherein the plug includes a shoulder portion configured for limiting the travel of the plug in the plug receiver portion.

7. The electrical contact of claim 1 wherein the bore and plug include chamfer surfaces that interface with each other for sealing the hole and closed end of the bore.

8. The electrical contact of claim 1 wherein the plug engages the bore proximate to the hole, to seal the hole and closed end of the bore.

9. The electrical contact of claim 4 wherein the hole is formed in the plug receiver portion of the bore.

10. The electrical contact of claim 1, wherein the plug includes a depression configured to facilitate installation.

11. The electrical contact of claim 1 wherein the mating portion includes at least one of a pin or a socket.

12. An electrical conductor assembly comprising:

an electrical conductor having a conductive core covered in insulation;

an electrical contact including a body having a mating portion and a barrel portion configured to receive the electrical conductor;

the barrel portion of the electrical contact including a bore formed therein and having a closed end and an open end, the open end of the bore configured for receiving the core of the electrical conductor;

a hole formed in the barrel portion and extending into the bore through a wall of the barrel portion;

a plug configured to be inserted into the bore to travel down the bore, the plug further configured to engage the bore formed in the barrel portion and to seal the hole and the closed end of the bore from the electrical conductor core and the rest of the bore.

13. The electrical conductor assembly of claim 12 wherein the barrel portion is configured for receiving the core and the insulation of the electrical conductor.

14. The electrical conductor assembly of claim 12 wherein the barrel portion of the body includes a region to receive at least one crimp for securing the electrical conductor with the electrical contact.

15. The electrical conductor assembly of claim 12 wherein the barrel portion of the body includes a core receiver portion for receiving the core of the electrical conductor and an insulation receiver portion configured for receiving the insulation of the electrical conductor, each of the core receiver portion and insulation receiver portion configured for receiving a crimp for securing the electrical conductor with the electrical contact.

16. The electrical conductor assembly of claim 12 wherein the bore includes a plug receiver portion positioned adjacent the closed end of the bore, the plug receiver portion configured to receive the plug for sealing the hole and closed end of the bore.

17. The electrical conductor assembly of claim 16 wherein the plug receiver portion is smaller in dimension than another portion of the bore and the plug provides a press fit into the plug receiver portion for sealing the hole and closed end of the bore.

18. The electrical conductor assembly of claim 12 wherein the plug engages the bore proximate to the hole, to seal the hole and closed end of the bore.

19. The electrical conductor assembly of claim 16 wherein the plug includes a shoulder portion configured for limiting the travel of the plug in the plug receiver portion.

20. The electrical conductor assembly of claim 16 wherein the hole is formed in the plug receiver portion of the bore.

* * * * *